United States Patent [19]

Payraudeau

[11] Patent Number: 4,618,050

[45] Date of Patent: Oct. 21, 1986

[54] DEVICE FOR LOCKING AND RELEASING OBJECTS INTENDED FOR PUBLIC USE, SUCH AS LUGGAGE CARTS

[75] Inventor: Henri-André Payraudeau, Draguignan, France

[73] Assignee: MORS, France

[21] Appl. No.: 657,531

[22] Filed: Oct. 4, 1984

Related U.S. Application Data

[63] Continuation-in-part of Ser. No. 515,372, Jul. 18, 1983, Pat. No. 4,589,538.

[30] Foreign Application Priority Data

| | | | |
|---|---|---|---|
| Feb. 18, 1983 | [FR] | France | 83 02716 |
| Apr. 26, 1983 | [FR] | France | 83 06857 |
| Oct. 7, 1983 | [FR] | France | 83 16031 |

[51] Int. Cl.[4] ..... G07F 7/00

[52] U.S. Cl. ..... 194/212; 194/253; 194/905

[58] Field of Search ..... 194/4 R, 4 B, 4 C, 4 D, 194/40, 54, 55, 59, 1 E, 212, 205, 253, 905

[56] References Cited

U.S. PATENT DOCUMENTS

| | | | |
|---|---|---|---|
| 441,536 | 11/1890 | Cornell | 194/102 X |
| 608,186 | 8/1898 | Doldt | 194/4 R |
| 608,769 | 8/1898 | Gilmer | 194/4 R |
| 2,753,970 | 7/1956 | Breeler | 194/40 |

FOREIGN PATENT DOCUMENTS

| | | | |
|---|---|---|---|
| 246487 | 6/1911 | Fed. Rep. of Germany . | |
| 400803 | 8/1924 | Fed. Rep. of Germany . | |
| 661352 | 6/1938 | Fed. Rep. of Germany | 194/55 |
| 1474887 | 7/1969 | Fed. Rep. of Germany | 194/55 |
| 2725530 | 12/1978 | Fed. Rep. of Germany . | |
| 2900367 | 7/1979 | Fed. Rep. of Germany | 194/4 R |
| 2425682 | 7/1979 | France . | |

*Primary Examiner*—F. J. Bartuska

*Attorney, Agent, or Firm*—Steinberg & Raskin

[57] ABSTRACT

The present invention is directed to a device for locking and releasing objects intended for public use, such as luggage carts which can be taken from a common stowage space and returned to the same. The device comprises a locking apparatus allowing each object to be automatically locked to an adjacent object or to a fixed point in compact storage position. A coin or the like is introduced into the locking apparatus to allow unlocking of the same and the concomitant release of the object by exerting a pull thereon. The locking apparatus returns the coin when the object is returned to the stowage space and is locked to an adjacent object or to the fixed point. Unlocking of the object is accomplished by just exerting a pull thereon after the coin has been appropriately inserted into the locking apparatus.

14 Claims, 22 Drawing Figures

DEVICE FOR LOCKING AND RELEASING OBJECTS INTENDED FOR PUBLIC USE, SUCH AS LUGGAGE CARTS

This is a continuation-in-part of application Ser. No. 515,372 filed July 18, 1983 now U.S. Pat. No. 4,589,538 for a device for locking and releasing objects intended for public use, such as luggage carts.

BACKGROUND OF THE INVENTION

The present invention has for a subject matter a device for locking and releasing objects intended for public use, particularly objects intended to be put at the public's disposal free of charge, such as luggage carts in a railway station or an airport, shopping trolleys in a self-service store, which objects the public can take directly from a common stowage space and must be taken back to the said space after being used.

It is known to provide such an object with a locking apparatus which allows locking it to an adjacent object or to a fixed point in a common stowage space. In the known systems, however, it is necessary, after introducing a coin or the like into the locking apparatus, to actuate a handle or press a button to unlock the object from an adjacent object or from a fixed point, the release of the object being thereafter obtained by exerting a pull thereon.

SUMMARY OF THE INVENTION

The purpose of the present invention is therefore to eliminate the additional, unlocking operation by providing a locking apparatus which is unlockable automatically by the introduction of a coin or the like, followed by a pull, and by preventing any fraud.

With this end in view, the present invention has for a subject matter a device for locking and releasing objects intended for public use, such as luggage carts, of the type comprising a locking apparatus allowing each object to be locked to the adjacent object or to a fixed point in stowed position, into which locking apparatus is introduced a coin or the like to allow unlocking the locking apparatus and the release of the object by exerting a pull thereon, the said locking apparatus being adapted to return the said coin or the like when the object is returned to the stowage space and is locked to an adjacent object or to a stationary point, characterized in that the said unlocking results from the said pull.

According to another feature of the invention, the said pull ensures successively the unblocking of the said locking apparatus and the release of the said object.

According to still another feature of the invention, the said locking apparatus comprises a slide movable under the action of the said pull and fixable by an internal blocking member which is moved to a non-blocking position by coming into contact with the edge of the said coin or the like, the said slide serving to lock or unlock the lock connecting the object to an adjacent object or to a fixed point.

According to another feature of the invention, the said locking apparatus comprises a movable means for retaining the said coin or the like in either of two positions in which the said coin is confined in the said locking apparatus, i.e., an active retained position ensuring the unlocking of the locking apparatus and an inactive retained position, respectively.

In order, in case a cart should be abandoned, to prevent the use of its locking bar to lock thereto one's cart, which would eventually result in an undesirable accumulation of carts at that location, the lock connecting the object to an adjacent object or to a fixed point is constituted, according to another feature of the invention, by a first or female and a second or male means secured to the end portion of the case of the locking apparatus.

According to another feature of the invention said locking bar is mounted on a removable support arbor of the longitudinally endmost portion of the casing of the locking apparatus.

Thus, the device according to the present invention allows ranks or lines of locked carts to be disrupted or broken up in order to transfer them to other, less charged ranks.

According to still another feature of the invention, the coin is introduced into the locking apparatus through a slit located on the external lateral wall of the cover of the locking apparatus casing. This feature offers the advantage of reducing the penetration of water and humidity capable of freezing the device on frost days.

BRIEF DESCRIPTION OF THE DRAWINGS

For a fuller understanding of the invention, reference is made to the following description taken in conjunction with the accompanying drawings, in which.

Figure 8:
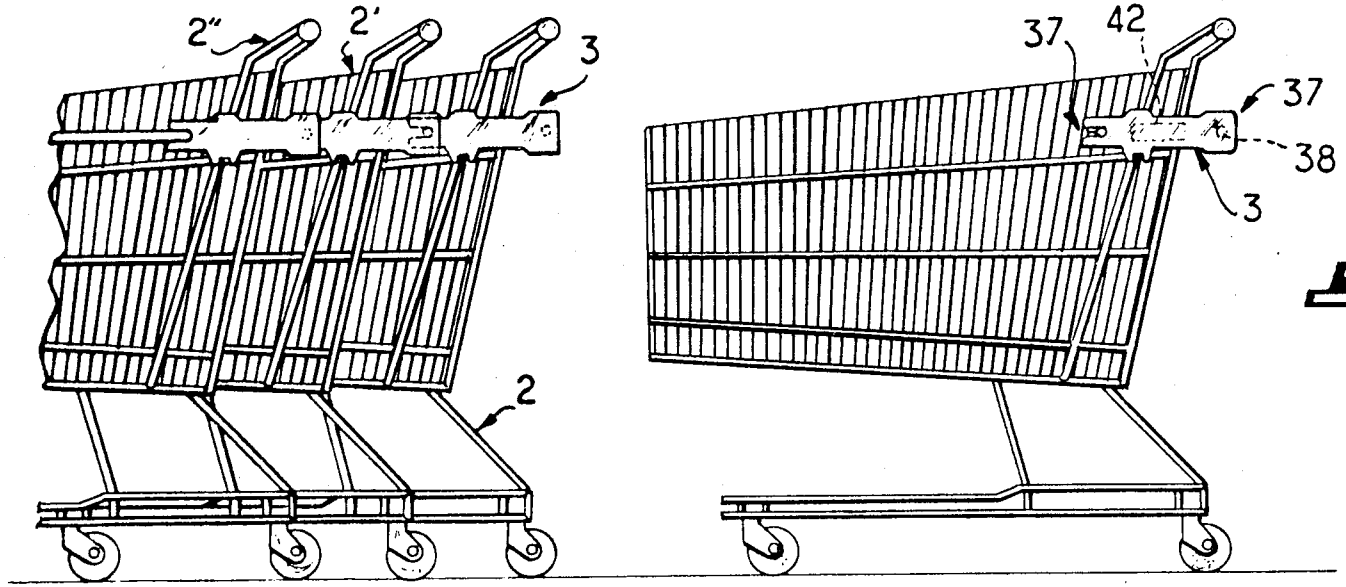
Figure 12:
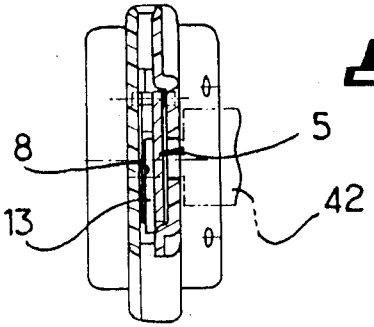
Figure 11:
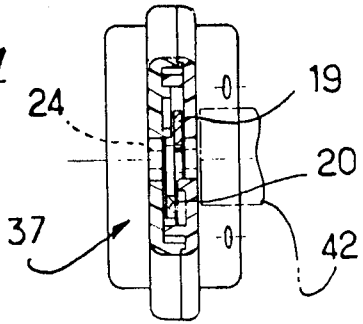
Figure 9:
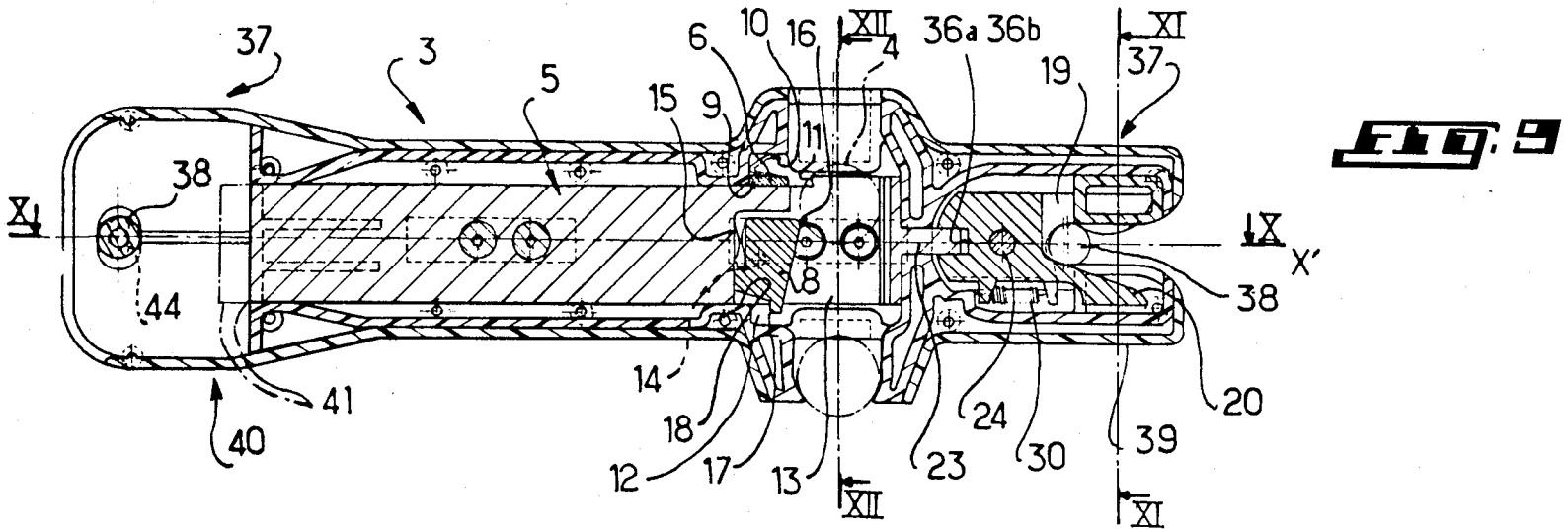
Figure 10:
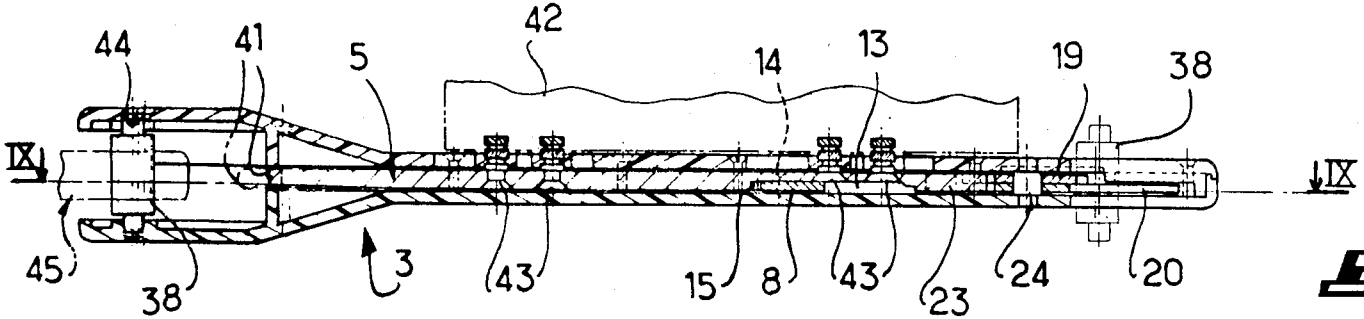
Figure 13:
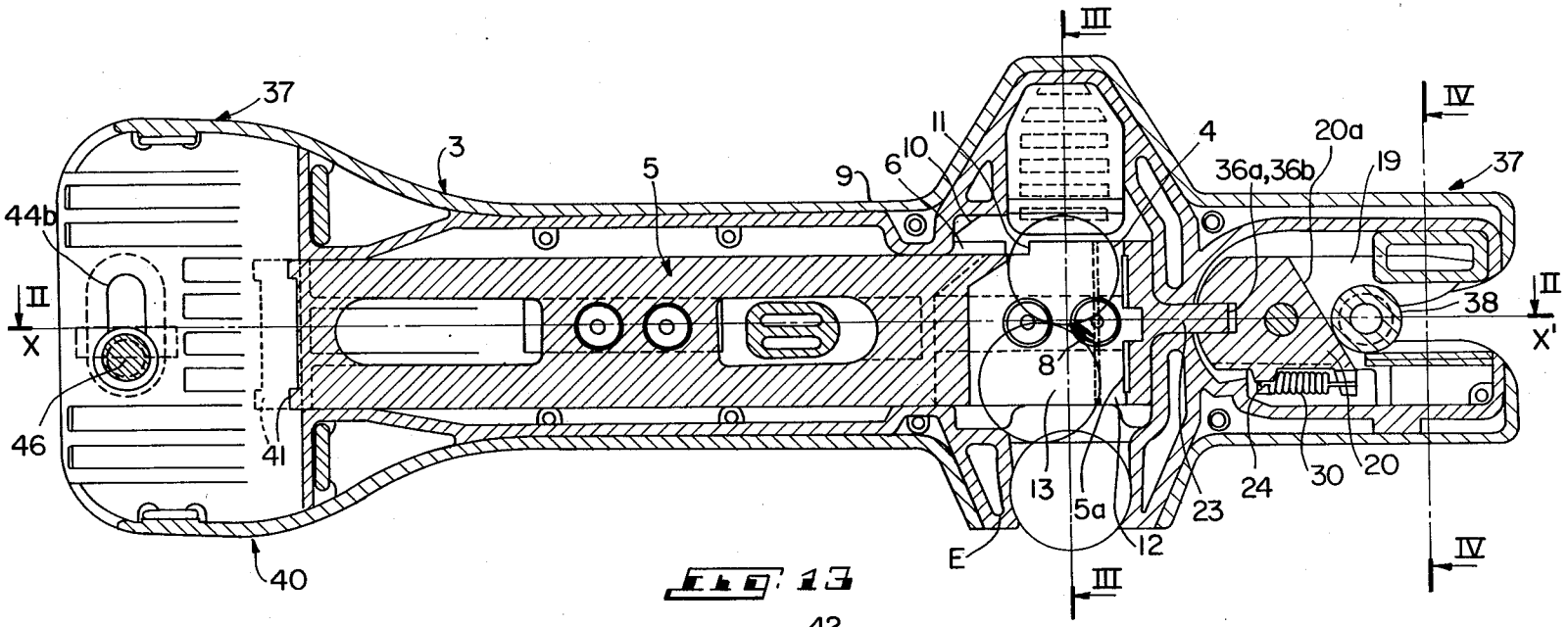
Figure 14:
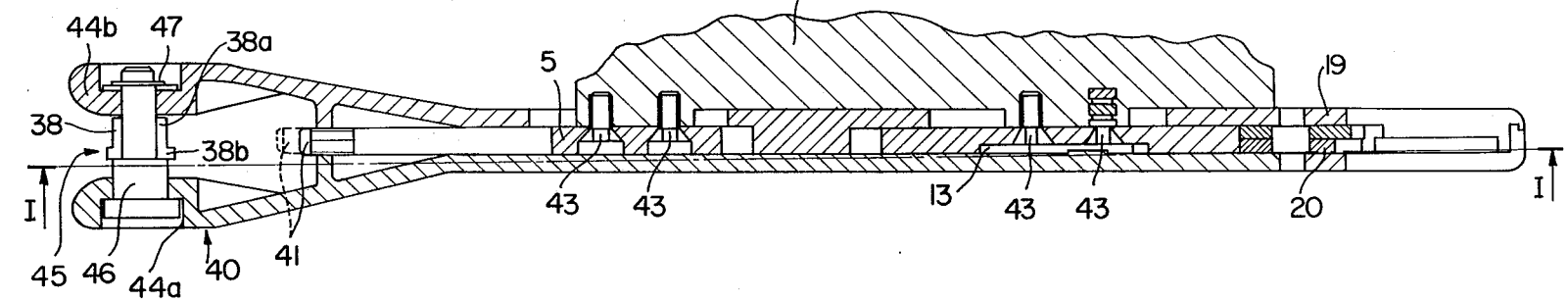
Figure 16:
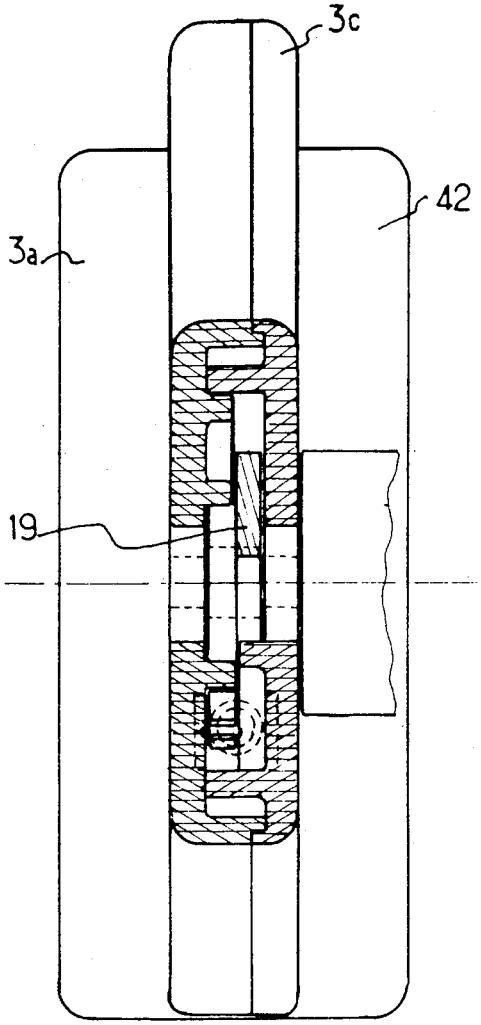
Figure 15:
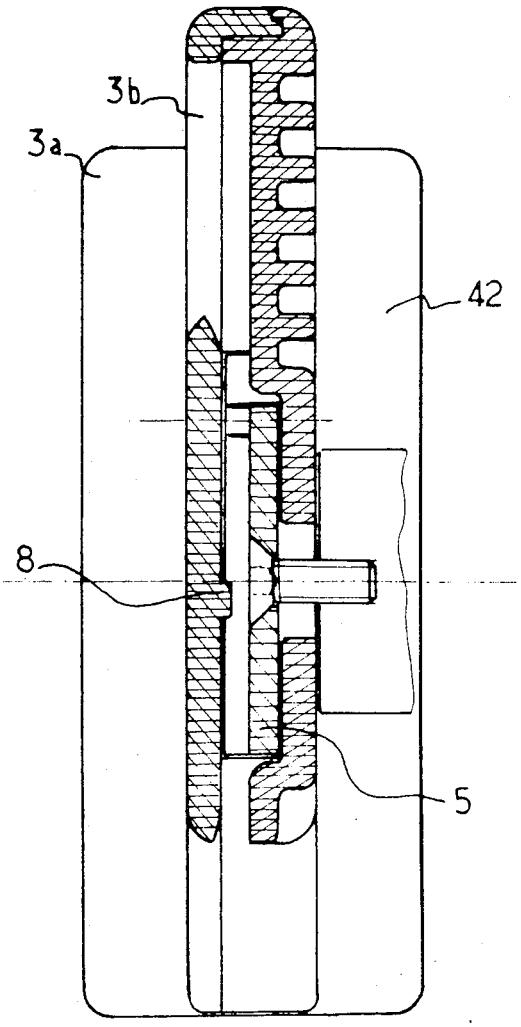

FIGS. *7a* to *7f* are diagrammatic sectional views illustrating the various stages of the operation of the device according to the invention;

FIG. 8 is a diagrammatic view of several carts locked together by a locking and releasing device according to another form of embodiment of the invention;

FIG. 9 is a view upon the line IX—IX of FIG. 10 illustrating one form of embodiment of a locking apparatus according to this second form of embodiment of the invention;

FIG. 10 is a view upon the line X—X of FIG. 9;

FIG. 11 is a view upon the line XI—XI of FIG. 9;

FIG. 12 is a view upon the line XII—XII of FIG. 9;

FIG. 13 is a sectional view upon the line XIII—XIII of FIG. 14 illustrating one example of embodiment of a locking apparatus according to the invention;

FIG. 14 is a sectional view upon the line XIV—XIV of FIG. 13;

FIG. 15 is a sectional view upon the line XV—XV of FIG. 13;

FIG. 16 is a sectional view upon the line XVI—XVI of FIG. 13; and

Figure 17:
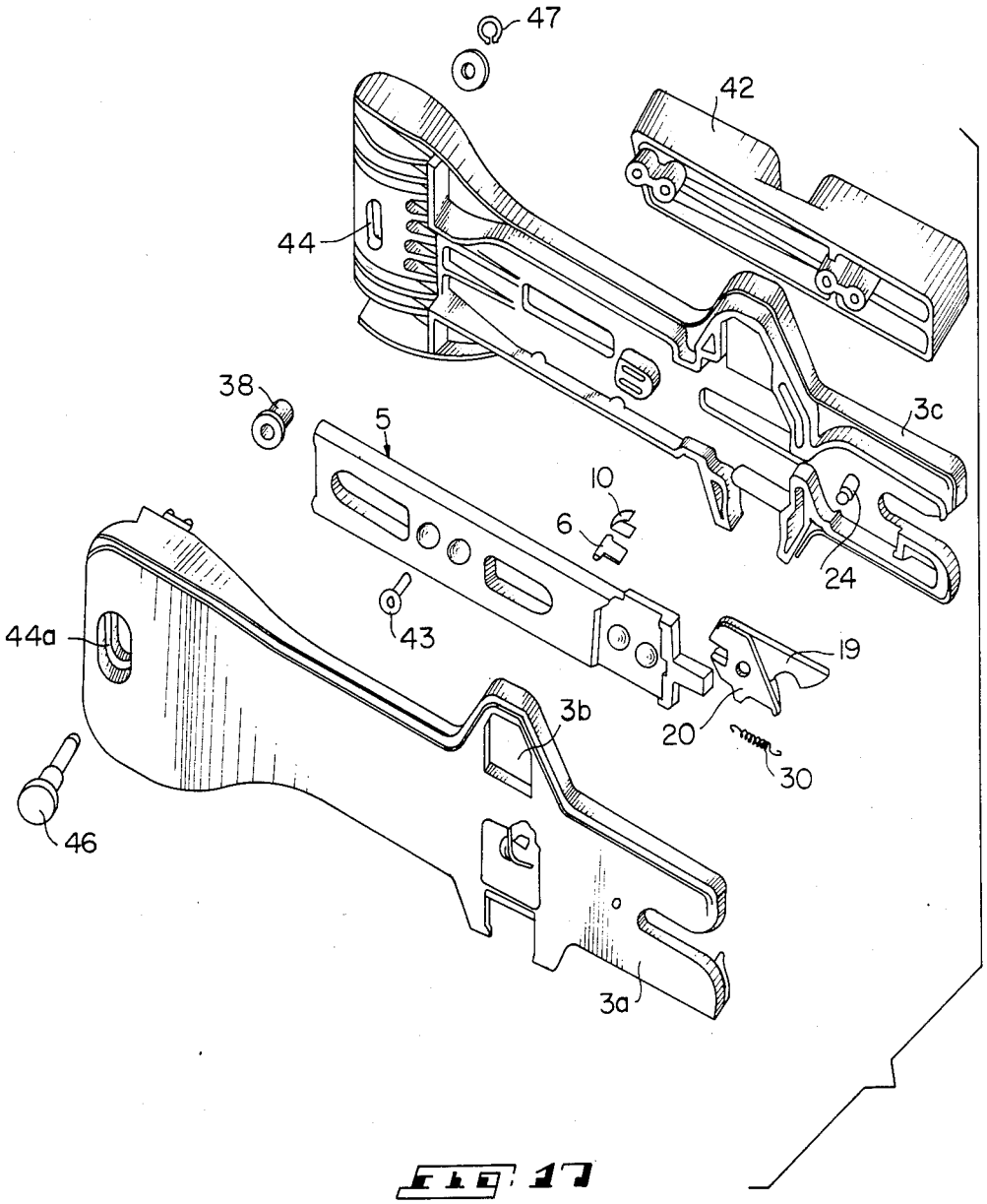

FIG. 17 is a perspective view of the various elements constituting the locking apparatus of the invention.

DESCRIPTION OF THE PREFERRED EMBODIMENTS

Figure 1:
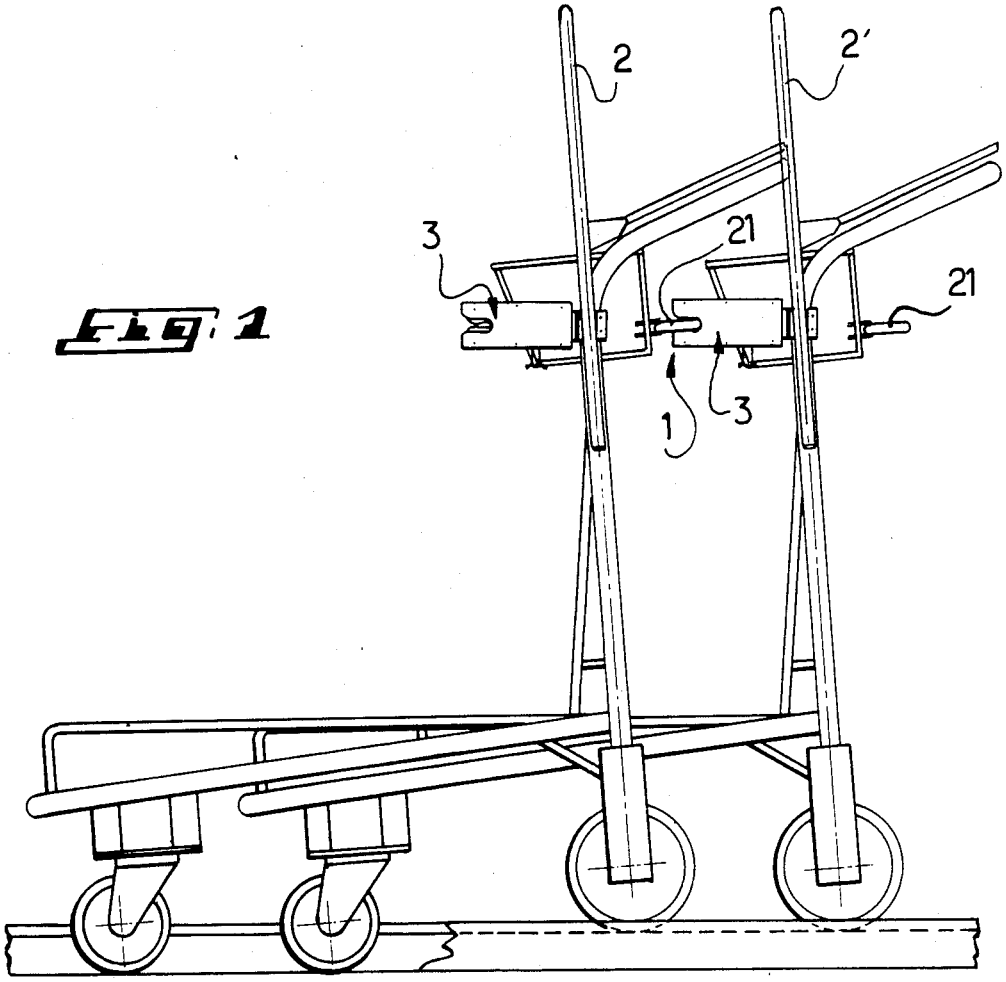
FIG. 1 is a diagrammatic view of the two luggage carts locked together by a locking and releasing device according to the invention.
Figure 6:
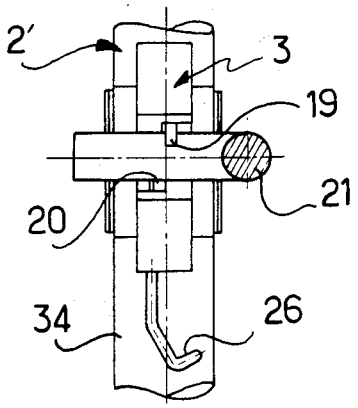
FIG. 6 is a view in the direction of arrow VI of FIG. 2.
Figure 2:
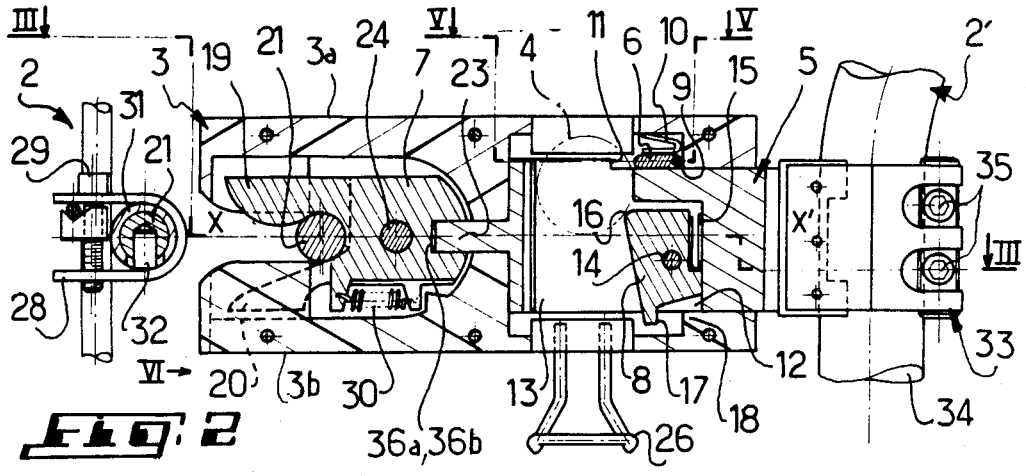
FIG. 2 is a view upon the line II—II of FIG. 3, illustrating one example of embodiment of a locking apparatus according to the invention.

Referring to FIG. 1, two luggage carts 2, 2' are shown in stowed position, locked to one another by a device 1 according to the invention.

The locking and releasing device 1 may be used to lock together or to a fixed point different objects intended for public use, in particular objects put at the public's disposal free of charge, such as luggage carts 2, 2' as in the example illustrated, in a railway station or an airport, or shopping trolleys in a self-service store, which objects the public can take directly from a common stowage space and which must be returned to the said stowage space after use.

Referring now more particularly to FIGS. 2 to 6, the device 1 comprises a locking apparatus 3 allowing each object to be automatically locked to the adjacent object or to a fixed point in stowed position, into which locking apparatus is introduced a coin or the like 4 for unlocking the lock 3 and releasing the object by exerting a pull thereon, the locking apparatus 3 being designed to return the coin or the like 4 when the object is taken back to the stowage space and is licked to an adjacent object or to a fixed point. According to the invention, the unlocking is obtained by exerting a pull on the object.

In particular, the said pulling action ensures successively the unblocking of the locking apparatus 3 and the release of the object 2'.

The locking apparatus 3 comprises a slide 5 movable under the action of the said pull and fixable by an internal blocking member 6 which is movable to a non-blocking position, when a sufficient pull is exerted, by coming into contact with the edge of the coin 4, the slide 5 serving to lock or unlock the lock 7 connecting the object to an adjacxent object or to a fixed point.

The locking apparatus 3 also comprises a movable means 8 for retaining the coin or the like 4 in either of two position in which the coin is confined in the locking apparatus 3, i.e., an active retained position ensuring the unblocking of the locking apparatus 3 and an inactive retained position, respectively.

In the example illustrated, the said blocking member is constituted by a stop or abutment 6 pivotally mounted on a pivot pin 9 which is substantially horizontal and perpendicular to the longitudinal axis X-X' of the locking apparatus 3, the case of which is constituted particularly by an upper frame **3*a* and a lower frame 3*b*. The stop 6 may be acted upon by the U-shaped-strip return-spring 10**.

The movable slide 5 has a shoulder 11 at its upper surface, opposite the free end of the stop 6. When no coin is introduced into the locking apparatus and when a pull is exerted on the object, the free end of the stop 6 moves into abutment against the shoulder 11, thus preventing the unlocking of the locking apparatus.

The aforesaid retaining means is particularly constituted by a rocker 8 provided in the recess 12 adjacent to the slit 13 extending throughout the locking apparatus 3 and pivotally mounted on a pivot pin 14 which is substantially horizontal and perpendicular to the longitudinal axis X-X' of the locking apparatus, the rocker 8 being acted upon by a spring 15. The rocker 8 may assume either of two positions according to whether a sufficient pull is or is not exerted on the object. Indeed, up to a predetermined value of the pulling action, the upper edge 16 of the rocker 8 retains the coin 4 in the slit 13 in its active position ensuring the unblocking of the locking apparatus 3. When this predetermined value is exceeded, the rocker 8 pivots by bearing with its lower edge 17 upon a shoulder 18 of the lower frame 3b of the locking apparatus 3, and the coin 4 moves down in the slit 13 by gravity and assumes an inactive retained position. When the object 2' is returned to the stowage space and is locked to an adjacent object or to a fixed point, the rocker 8 pivots in the opposite direction and releases the coin 4 from the slit 13. The coin can thus be recovered.

The connecting lock 7 is advantageously constituted by a clamp constituted by two unsymmetrical jaws 19, 20 pivotally mounted about a pin 24 which is substantially horizontal and perpendicular to the longitudinal axis X-X' of the locking apparatus 3. The jaws 19, 20 are acted upon by a spring 30 and so designed that only a connecting bar 21 secured to the adjacent object or to a fixed point and whose diameter is perfectly calibrated can fit in therebetween and lock the object. The connecting bar 21 may be provided with a torsion spring 22 so as to be resiliently rotatable through a certain angle to compensate for the difference in height between two adjacent carts, due for example to the mounting tolerances or the unevenness of the ground or to tire wear.

Figure 3:
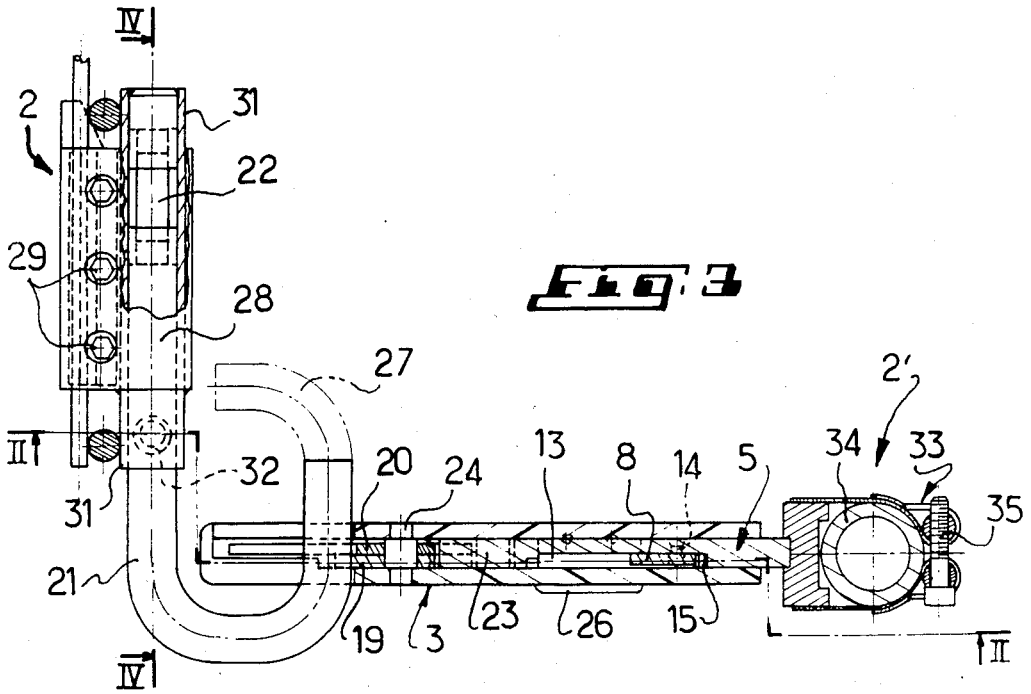
FIG. 3 is a view upon the line III—III of FIG. 2.
Figure 4:
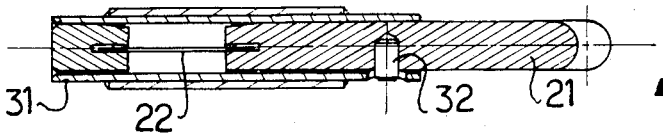
FIG. 4 is a view upon the line IV—IV of FIG. 3.
Figure 5:
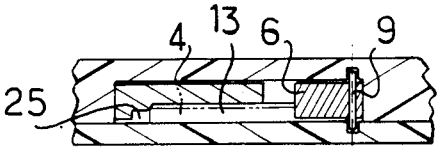
FIG. 5 is an enlarged view upon the line V—V of FIG. 2.

In case there is a possibility of lateral movement of the object, the bar 21 may be prolonged by a bend 27 shown in dash-dotted lines in FIG. 3, which bend may, if appropriate, be prolonged to form a closed loop.

The connecting bar 21 may be secured to the adjacent object by means of, for example, a U-shaped plate 28 by means of safety screws 29. A sleeve 31 may be arranged between the bar 21 and the plate 28 and secured for example by menas of a screw 32.

Furthermore, the movable slide is provided with a tongue 23 holding the jaws 19, 20 of the clamp 7 in closed position. To this end, the jaws 19, 20 are provided, on their innermost portion in the locking apparatus, with mutually opposite recesses **36*a*, 36*b* which, in the locked position of the locking apparatus, define a space in which the free end of the tongue 23** is located so as to block the locking apparatus in that position.

The slit 13 extending throughout the locking apparatus includes an anti-fraud extension 25 the width of which is smaller than the thickness of the required coin, so that a coin of the same diameter but of smaller thickness than the required coin traverses the locking apparatus without being retained therein.

Also provided is a coin recovery means 26 secured to the lower surface of the lower frame **3*b* of the locking apparatus in prolongation of the slit 13**.

The locking apparatus 3 is secured to the handlebar 34 of the cart 2' by fastening means 33 including particularly safety screws 35.

Referring more particularly to FIGS. **7*a* to 7*f***, there will now be described the various phases of operation of the locking and releasing device according to the invention.

FIG. **7*a* illustrates the phase of introduction of the coin or the like 4 into the locking apparatus 3. Once in the slit 13, the coin 4 is retained therein by the upper end 16 of the rocker 8 in an active position ensuring the unblocking of the locking apparatus. In this position of the coin 4, when a pull is exerted on the object, the free end of the stop 6 slips on the edge of the coin 4, thus preventing it from abutting against the shoulder 11 of the slide 5**. This position corresponds to the unblocking of the locking apparatus.

Figure 7A:
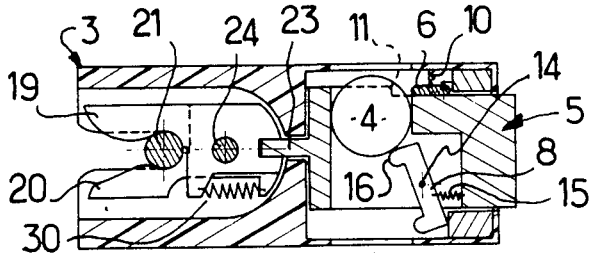
Figure 7B:
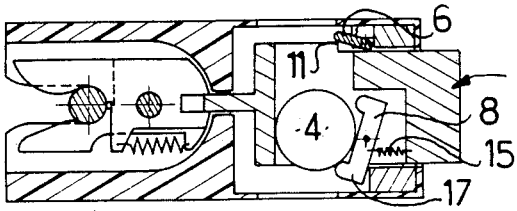

As the pull is continued, the lower end 17 of the rocker 8 abuts against the shoulder 18 of the lower frame 3*b* of the locking apparatus 3, so that the rocker 8 pivots and frees the coin 4 from its preceding position. The coin then falls by gravity in the slit 13 where it assumes an inactive retained position (FIG. 7*b*). The stop 6 then rests on the edge of the shoulder 11.

Figure 7C:
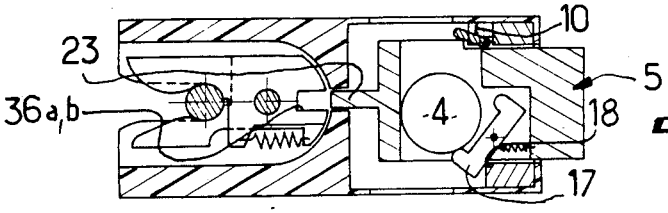
Figure 7D:
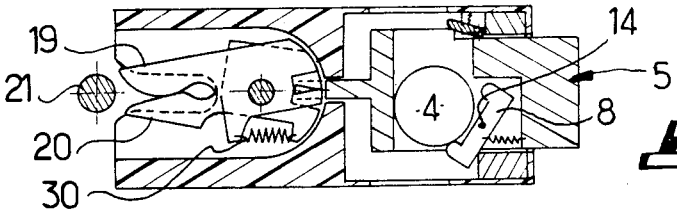

As the pull is continued, the tongue 23 of the slide 5 leaves the space defined by the mutually opposite recesses 36*a*, 36*b* of the jaws 19, 20 of the clamp 7 (FIG. 7*c*), thus causing the jaws 19, 20 to pivot about their pivot pin 24 under the action of the return spring 30 and thus free the calibrated bar 21 (FIG. 7*d*). This correpsonds to the unlocking of the locking apparatus. In this position of the jaws 19, 20, the recesses 36*a*, 36*b* are no longer opposite one another, so that, so long as a calibrated bar 21 is not inserted between the jaws 19, 20, the slide 5 is blocked in the unlocked position.

Figure 7E:
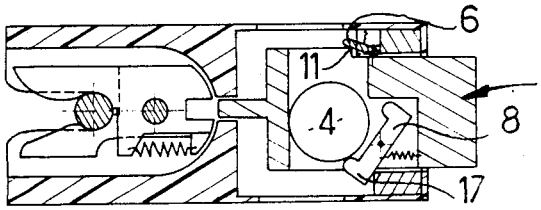
Figure 7F:
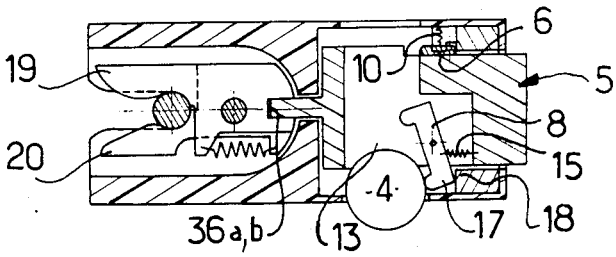

When the object, for example a luggage cart, is returned to the stowage space, a push exerted on the latter allows inserting the calibrated bar 21 between the jaws 19, 20 of the clamp 7 (FIG. 7*e*), so that the recesses 36*a*, 36*b* are again opposite one another. As the push is continued, the tongue 23 of the slide 5 moves into the space defined by the recesses 36*a*, 36*b*, whereas the rocker 8 pivots and the coin 4 is freed (FIG. 7*f*). At the same time, the stop 6 reassumes its initial horizontal position and the locking apparatus 3 is then again locked. As appears from FIG. 7*f*, if no coin or the like is introduced into the locking apparatus and in case a pull is exerted on the object, the stop 6 will abut against the shoulder 11 and prevent the unlocking of the lock.

Referring to FIG. 8, several luggage carts 2, 2', 2'' are shown in stowed position and locked to one another by a device according to a second form of embodiment of the invention.

Referring now to FIGS. 9 to 10, the device comprises a locking apparatus 3 allowing each object to be automatically locked to the adjacent object or to a fixed point in stowed position, in which locking apparatus is introduced a coin or the like 4 to authorize the unlocking of the locking apparatus 3 and the release of the object by a pull exerted thereon, the locking apparatus 3 being designed to return the coin 4 when the object is returned to the stowage space and is locked to an adjacent object or to a fixed point, the locking being performed by exerting a pull on the object. In particular, the said pull results successively in the unblocking of the locking apparatus 3 and the unlocking of the object.

It is recalled that the locking apparatus 3 comprises a slide 5 which is movable by the said pull and fixable by an internal blocking member 6 which is moved to a non-blocking position, when a sufficient pull is exerted, by coming into contact with the edge of the coin 4, the slide 5 serving to lock or unlock the lock 37 connecting the object to an adjacent object or to a fixed point.

The locking apparatus 3 also comprises a movable means 8 for retaining the coin 4 in either of two positions in which the coin is confined in the locking apparatus 3, i.e., an active retained position ensuring the unblocking of the locking apparatus 3 and an inactive retained position, respectively.

In the example illustrated, the blocking member is constituted by a stop or abutment 6 mounted pivotally about a substantially horizontal pivot pin 9 perpendicular to the longitudinal axis X-X' of the locking apparatus 3. The stop 6 is acted upon a U-shaped-strip return-spring 10.

The movable slide 5 is provided with a shoulder 11 at its upper face, opposite the free end of the stop 6. When no coin is introduced into the locking apparatus and when a pull is exerted on the object, the free end of the stop 6 abuts against the shoulder 11, thus preventing the unlocking of the locking apparatus.

The said retaining means is particularly constituted by a rocker 8 provided in the recess 12 adjacent to the slit 13 traversing the locking apparatus 3 and pivotally mounted about a substantially horizontal pivot pin 14 perpendicular to the longitudinal axis X-X' of the locking apparatus, the rocker 8 being acted upon by a spring 15. The rocker 8 can assume two positions according to whether a sufficient pull is exerted on the object or not. Indeed, up to a predetermined value of the pull, the upper edge 16 of the rocker 8 retains the coin 4 in the slit 13 in an active position in which the locking apparatus 3 connot be locked. When this predetermined value is exceeded, the rocker 8 pivots by bearing by its mower edge 17 on the shoulder 18 of the frame of the locking apparatus 3, and the coin 4 moves downward in the slit 13 by gravity and assumes an inactive retained position. When the object is returned to the stowage space and is locked to an adjacent object or to a fixed point, the rocker 8 pivots in the opposite direction, thus freeing the coin in the slit 13. The coin can thus be recovered.

According to this second form of embodiment of the invention, the lock 37 for connecting the object to an adjacent object or to a fixed point is constituted by a first or female and a second or male means secured to the longitudinal endmost portion 39, 40, respectively, of the case of the locking apparatus 3. The said first means secured to the longitudinal end 39 of the locking apparatus 3, i.e., as in the example illustrated, the right-hand end in FIG. 9, is constituted particularly by a clamp consisting of two unsymmetrical jaws 19, 20 acted upon by a spring 30 and so designed that only the connecting or locking bar 38, constituting the said second means, for an adjacent object, and whose diameter is perfectly calibrated, can fit in therebetween. In the example illustrated, the connecting bar 38 is secured to the endmost portion 40 of the case of the locking apparatus 3 (at the left in FIG. 9) adjacent to the free end 41 of the slide 5, and is spaced from the latter, in locked position, by a sufficient space to introduce the said bar between the jaws of the locking apparatus of an adjacent object.

Thus, in the unlocked position, the free end 41 of the slide 5, shown in FIG. 10 is dash-dotted lines, prevents the locking of the cart to another cart. Indeed, the space then existing between the connecting bar 38 and the free end 41 of the slide 5 is insufficient to allow the introduction of the bar 38 between the jaws 19, 20 of another cart. Thus, in case a cart is abandoned, it is not possible, owing to this design of the locking apparatus, to use its locking bar in order to lock one's cart. In other words, the locking of a cart must compulsorily be effected to an already locked cart.

The movable slide 5 also comprises a tongue 23 locking the jaws 19, 20 of the clamp in locked position. Indeed, the jaws 19, 20 are provided, in their innermost portion in the locking apparatus, with recesses 36*a*, 36*b* arranged so as to be located opposite one another, in the locked position of the locking apparatus, to thus define a space in which the end of the tongue 23 is accommodated, in the locked position, so as to block the locking apparatus in this position.

The locking apparatus 3 may be secured to a cart by any appropriate fixing members 42 through the medium of appropriate fastening means 43 such as screws, bolts or the like.

Furthermore, there may be provided an oblong recess 44 for the calibrated bar 38 so as to compensate for the differences in height between the carts, and an opening 45 in the endmost portion 40 of the locking apparatus 3 so dimensioned as to provide a lateral clearance between the carts.

The operation of the locking apparatus has been described in detail with reference to the first form of embodiment.

The locking and releasing device according to the invention may also be used for storing collective tools in workshops. In this case, the locking apparatus is intended to lock or unlock a case in which the tool is contained. Every worker has a personal coin or the like marked for example with a number. When the worker wishes to use the tool, he introduces the coin into the locking apparatus, thus allowing the case containing the tool to be unlocked. The locking apparatus being provided with a transparent aperture, it can be seen, on the one hand, in case there is no coin or the locking apparatus, whether the object is available, or, on the other hand, in case a coin is seen in the locking apparatus, in the hands of what worker the tool is.

FIGS. 13 to 17 show a third form of embodiment of the invention, the same reference numerals as used in the other embodiments designating the same elements.

As illustrated in the Figures and particularly in FIG. 17, the retaining means 8 is constituted by a projection cast integrally with the internal face of the cover 3*a* of the locking apparatus and assumes a predetermined position in the housing 12 of the slit 13 extending throughout the locking apparatus 3, the said projection 8 being located substantially at the longitudinal axis X-X' of the locking apparatus. Such a projection is advantageously used instead of the rocker and spring of the retaining means described in the other embodiments and allows a considerable saving of time in mounting the locking apparatus and an improved reliability thereof (elimination of the movable parts) while at the same time having no unfavorable effect on the operation of the device. Indeed, up to a definite value of the pull, i.e., up to a certain displacement of the movable slide 5 towards the left in FIG. 13 with respect to the projection 8, the latter retains the coin 4 in an active position ensuring the unblocking of the locking apparatus 3 in the slit 13. When this predetermined value is exceeded, the coin 4 moves down in the slit 13 by gravity and assumes an inactive retained position as shown by a thin line in FIG. 1. The coin 4 is maintained in inactive position by resting, on the one hand, on the vertical wall 5*a* (shown in dash-dotted lines) of the slide 5 and, on the other hand, on an upper curvilinear portion of the recovery funnel E. When the object is taken back to the stowage space and is locked to an adjacent object or to a fixed point, the slide 5 moves towards the right (in FIG. 13) so as to free the coin from the slit 13, and the coin can thus be recovered.

As shown more particularly in FIG. 14, the locking pin or bar 38 is mounted on a support arbor 46 connected to the endmost portion 40 of the casing of the locking apparatus 3 (in the left-hand portion of FIG. 14) adjacent to the free end 41 of the slide 5 and spaced from the latter, in the locked position, a sufficient distance to allow the pin 38 to be inserted between the jaws of the locking apparatus of an adjacent object. Thus, and as already previously mentioned, in the unlocked position, the free end 41 of the slide 5, shown in interrupted lines in FIG. 2, prevents the locking of the cart to another cart. Indeed, the space which is then present between the locking pin 38 and the free end 41 of the slide 5 is insufficient to allow the introduction of the pin 38 between the jaws 19, 20 of another cart. Thus, in case a cart is abandoned, it is no longer possible, owing to this design of the locking apparatus, to use its locking pin in order to lock one's cart. In other words, a cart cannot be locked except to an already locked cart.

Referring again to FIG. 14, the support arbor 46 extends through the opening 45 of the endmost portion 40 of the locking apparatus 3 (this opening being so dimensioned as to provide a lateral clearance between carts) and is removable perpendicularly to the longitudinal axis X-X' of the casing of the locking apparatus after removing a circlip element 47. The possibility of removing the support arbor 46 allows disrupting or breaking up ranks of carts in order to transfer them to other, less charged ranks.

The locking pin 38 includes a first cylindrical hollow portion 38*a* connecting at one of its ends with a second cylindrical shoulder portion 38*b* laterally abutting against a corresponding shoulder of the arbor 46. The diameter of each of the two cylindrical portions 38*a*, 38*b* is so calibrated as to allow it to be inserted between the jaws 19, 20.

As shown in FIGS. 13, 14 and 17, there may also be provided oblong apertures 44*a*, 44*b* for the support arbor 46 so as to compensate for the differences in height between the carts.

As shown in FIG. 13, the jaw 19 is so shaped that the calibrated cylindrical portion 38*a* of the pin 38 fits therein, whereas the jaw 20, which is smaller in length than the jaw 19, has an oblique surface 20*a* against which, in the locked position, the circular external surface of the shoulder 38*b* bears. Thus, the unlocking of the locking apparatus is made difficult for defrauders, the jaw 20 being partially covered by the cover 3*a* of plastic material.

It should be noted that, when the support arbor 46 is removed from the locking apparatus 3 in order to disrupt a rank of carts, the locking pin 38 remains inserted between the jaws 19, 20 of the locking apparatus of the adjacent cart.

FIG. 17 is an exploded perspective view of the various locking apparatus elements described. There also appears in this Figure a slit 3*b* provided on the external lateral wall of the cover 3*a* of the locking apparatus casing 3*a* and through which the coin or the like 4 is introduced. The modification of the location of this slit as compared with the device of the embodiments of FIGS. 1 to 12 offers the advantage of reducing the penetration of water and humidity capable of freezing the locking apparatus on frost days.

The operation of the locking apparatus of the third embodiment is the same as the others and has not been described again.

What is claimed is:

1. A device for locking and releasing objects intended for public use, especially objects to be put at public disposal free of charge, such as luggage carts in a railway station or an airport or shopping carts in self-service stores, such objects capable of being taken directly from a common storage station and returned to the storage station, said device including a locking apparatus in the form of a casing and adapted to be affixed to a part of each object, attaching means for affixing said locking apparatus to a part of each object, a connecting lock having male and female means secured to respective longitudinal endmost portions of said casing forming said locking apparatus, for locking each object to an adjacent object or to a fixed point in compact storage position, and a slit provided in said casing through which a coin or the like is introduced to allow unlocking of said locking apparatus and release of the object by exerting a pull thereon, said locking apparatus being arranged to return the coin or the like when the object is returned to the storage station and is locked by said connecting lock to the adjacent object or to the fixed point, wherein said female means is constituted by a clamp comprising two unsymmetrical jaws, and said male means is constituted by a connecting bar secured to the object or to the fixed point, and having a diameter perfectly calibrated so that said male means can fit in between said jaws, wherein said connecting bar secured to the object comprises a first portion in the form of a hollow cylinder and a second portion forming a cylindrical shoulder integral with said first portion, said portions are mounted on a support arbor removably secured to the endmost portion of said casing of said locking apparatus with the first hollow cylindrical portion having a diameter corresponding to said calibrated diameter to allow said cylindrical portion to fit into a first one of said jaws of the locking apparatus of an adjacent object, the second jaw being so shaped as to allow said second cylindrical shoulder, having a calibrated diameter, to bear thereon, the removal of said support arbor from the endmost portion of said casing permitting direct release of the adjacent object from said object, both forming part of a rank of objects locked to one another, in order to disrupt said rank.

2. A device according to claim 1, wherein said locking apparatus further comprises a slide provided with a tongue blocking said clamp in locked position so as to lock said connecting lock connecting the object to the adjacent object or to the fixed point, an internal blocking member for fixing said slide and being movable to a non-blocking position by coming into contact with an edge of said coin introduced within said slit.

said slide being movable within said casing, ater introducing the coin within the slit, under the single action of the pull on the object which is directly applied to the slide so as to successively move the blocking member to the non-blocking position by coming into contact with the edge of the inserted coin, unlock the clamp of the connecting lock connecting the object to the adjacent object or to the fixed point and release the object.

3. A device according to claim 1, wherein said connecting bar is secured to the endmost portion of said casing of said locking apparatus adjacent to a free end of said slide and spaced from the latter, in the locked position, by a sufficient space to allow said bar to be inserted between said jaws of said locking apparatus of an adjacent object.

4. A device according to claim 1, wherein said locking apparatus comprises means for retaining the coin in either of two positions in which the coin is confined within said locking apparatus, said two positions being an active retained position ensuring unlocking of the locking apparatus and an inactive retained position, respectively.

5. A device according to claim 3, wherein said blocking member comprises a pivotally mounted stop or abutment, and a substantially horizontal pivot pin about which said stop or abutment is pivotally mounted, said pivot pin being disposed perpendicular to a longitudinal axis of said locking apparatus.

6. A device according to claim 5, wherein said slide is provided with a shoulder at an upper face thereof opposite a free end of said stop or abutment.

7. A device according to claim 4, wherein said retaining means comprise a rocker provided in a recess adjacent to said slit extending throughout said locking apparatus, and a substantially horizontal pivot pin perpendicular to a longitudinal axis of said locking apparatus, and about which said rocker is pivotally mounted.

8. A device according to claim 1, wherein said connecting bar is provided with a torsion spring.

9. A device according to claim 1, wherein said slit extending throughout said locking apparatus comprises an extension having a width smaller than the thickness of the required coin, so that a coin of the same diameter but of a smaller thickness than the required coin traverses said locking apparatus without being retained therewithin.

10. A device according to claim 1, wherein said support arbor is removable perpendicularly to the longitudinal axis of the casing of locking apparatus after removing a circlip element.

11. A device according to claim 24, wherein said retaining means is in the form of a projection integral with the cover of the casing of the locking apparatus and occupies a defined position in the slit extending through the locking apparatus.

12. A device according to claim 1, wherein said slit for introducing a coin is located on the external lateral wall of the cover of the casing of the locking apparatus.

13. A device for locking and releasing objects intended for public use, especially objects intended to be put at public disposal free of charge, such as luggage carts in a railway station or an airport, or shopping carts in self-service stores, such objects capable of being taken directly from a common storage station and returned to the storage station, said device including a locking apparatus in the form of a casing and adapted to be affixed to a part of each object, attaching means for affixing said locking apparatus to a part of each object, a connecting lock having male and female means secured to respective longitudinal endmost portions of said casing forming said locking apparatus, for locking each object to an adjacent object or to a fixed point in compact storage position, and a slit provided in said casing through which a coin or the like is introduced to allow unlocking of said locking apparatus and release of the object by exerting a pull thereon, said locking apparatus being arranged to return the coin or the like when the object is returned to the storage station and is locked by said connecting lock to the adjacent object or to the fixed point, wherein said female means is constituted by a clamp comprising two unsymmetrical jaws, and said male means is constituted by a connecting bar secured to the object or to the fixed point, and having a diameter perfectly calibrated so that said male means can fit in between said jaws, wherein said connecting bar secured to the object comprises a first portion in the form of a hollow cylinder and a second portion forming a cylindrical shoulder integral with said first portion, wherein said portions are mounted on a support arbor removably secured to the endmost portion of said casing of said locking apparatus with the first hollow cylindrical portion having a diameter corresponding to said calibrated diameter to allow said cylindrical portion to fit into a first one of said jaws of the locking apparatus of an adjacent object, the second jaw being so shaped as to allow said second cylindrical shoulder, having a calibrated diameter, to bear thereon, the removal of said support arbor from the endmost portion of said casing permitting direct release of the adjacent object from said object, both forming part of a rank of objects locked to one another, in order to disrupt said rank, and wherein said connecting bar remains inserted between the two jaws of the locking apparatus of the adjacent object once said support arbor is removed.

14. A device for locking and releasing objects intended for public use, especially objects intended to be put at public disposal free of charge, such as luggage carts in a railway station or an airport, or shopping carts in self-service stores, such objects capable of being taken directly from a common storage station and returned to the storage station, said device including a locking apparatus in the form of a casing and adapted to be affixed to a part of each object, attaching means for affixing said locking apparatus to a part of each object, a connecting lock having male and female means secured to respective longitudinal endmost portions of said casing forming said locking apparatus, for locking each object to an adjacent object or to a fixed point in compact storage position, and a slit provided in said casing through which a coin or the like is introduced to allow unlocking of said locking apparatus and release of the object by exerting a pull thereon, said locking apparatus being arranged to return the coin or the like when the object is returned to the storage station and locked by said connecting lock to the adjacent object or to the fixed point, wherein said female means is constituted by a clamp comprising two unsymmetrical jaws, and said male means is constituted by a connecting bar secured to the object or to the fixed point, and having a diameter perfectly calibrated so that said male means can fit in between said jaws, wherein said locking apparatus comprises a slide provided with a tongue blocking said clamp in locked position so as to lock said connection lock connecting the object to the adjacent object or to the fixed point, an internal blocking member fixing said slide and being movable to a non-blocking position by coming into contact with an edge of the coin introduced within said slit, wherein said connecting bar secured to the object comprises a first portion in the form of a hollow cylinder and a second portion forming a cylindrical shoulder integral with said first portion, and wherein said portions are mounted on a support arbor removably secured to the endmost portion of said casing of said locking apparatus adjacent to a free end of said slide and spaced from the latter, with the first hollow cylindrical portion having a diameter corresponding to said calibrated diameter to allow said cylindrical portion to fit into a first one of said jaws of the locking apparatus of an adjacent object, the second jaw being so shaped as to allow said second cylindrical shoulder, having a calibrated diameter, to bear thereon, the removal of said support arbor from the endmost portion of said casing permitting direct release of the adjacent object from said object, both forming part of a rank of objects locked to one another, in order to disrupt said rank, said connecting bar remaining inserted between the two jaws of the locking apparatus of the adjacent object once said support arbor is removed.

* * * * *